US010472220B2

(12) United States Patent
Moore et al.

(10) Patent No.: US 10,472,220 B2
(45) Date of Patent: Nov. 12, 2019

(54) DISPENSING NOZZLE ASSEMBLY

(71) Applicant: The Coca-Cola Company, Atlanta, GA (US)

(72) Inventors: William J. Moore, Lilburn, GA (US); Caitlin Lahey, Atlanta, GA (US); Bernard Phoenix, Douglasville, GA (US); Joshua Allen Maust, Roswell, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 15/840,738

(22) Filed: Dec. 13, 2017

(65) Prior Publication Data

US 2018/0162710 A1 Jun. 14, 2018

Related U.S. Application Data

(60) Provisional application No. 62/433,886, filed on Dec. 14, 2016.

(51) Int. Cl.
*B67D 1/00* (2006.01)

(52) U.S. Cl.
CPC ..... *B67D 1/0022* (2013.01); *B67D 1/00* (2013.01); *B67D 1/0043* (2013.01); *B67D 1/0052* (2013.01); *B67D 1/0085* (2013.01); *B67D 1/0081* (2013.01)

(58) Field of Classification Search
CPC .. B67D 1/0022; B67D 1/0081; B67D 1/0043; B67D 1/0051; B67D 1/0052; B67D 1/005; B67D 1/0021; B67D 1/0044
See application file for complete search history.

(56) References Cited

U.S. PATENT DOCUMENTS

| | | | | |
|---|---|---|---|---|
| 4,781,309 | A * | 11/1988 | Vogel | B67D 1/0021 137/561 A |
| 7,578,415 | B2 * | 8/2009 | Ziesel | B67D 1/0051 222/129.1 |
| 7,866,509 | B2 | 1/2011 | Ziesel | |
| 8,162,177 | B2 | 4/2012 | Ziesel | |
| 8,328,050 | B2 | 12/2012 | Ziesel | |
| 8,820,580 | B2 | 9/2014 | Ziesel | |
| 2007/0131715 | A1 * | 6/2007 | Minard | B67D 1/0044 222/145.5 |
| 2010/0012532 | A1 * | 1/2010 | Frutin | B65D 47/242 206/221 |
| 2014/0361042 | A1 | 12/2014 | Ziesel | |
| 2015/0315006 | A1 | 11/2015 | Ziesel | |

* cited by examiner

*Primary Examiner* — Nicholas J. Weiss
(74) *Attorney, Agent, or Firm* — Eversheds Sutherland (US) LLP

(57) ABSTRACT

The present application provides a dispensing nozzle assembly. The dispensing nozzle assembly may include a core module assembly and an injector ring assembly surrounding the removable core module assembly. The injector ring assembly may include a number of first paths surrounding the core module assembly and extending to a dispensing ring and a number of second paths surrounding the first paths and extending to the dispensing ring.

20 Claims, 11 Drawing Sheets

DISPENSING NOZZLE ASSEMBLY

RELATED APPLICATIONS

The present application claims priority from U.S. Provisional Application No. 62/433,886, filed on Dec. 14, 2016, entitled "DISPENSING NOZZLE ASSEMBLY." U.S. Provisional Application No. 62/433,886 is incorporated herein by reference in full.

TECHNICAL FIELD

The present application and the resultant patent relates generally to dispensing nozzle assemblies for beverage dispensers and more particularly relates to multi-flavor or multi-fluid dispensing nozzle assemblies capable of dispensing a large number of different types of fluids.

BACKGROUND OF THE INVENTION

Current post-mix beverage dispensing nozzles generally mix streams of syrup, concentrate, sweetener, bonus flavors, other types of flavoring, and other ingredients with water or other types of diluent by flowing the syrup stream down the center of the nozzle with the water stream flowing around the outside. The syrup stream is directed downward with the water stream such that the streams mix as they fall into a consumer's cup.

There is a desire for a beverage dispensing system as a whole to provide as many different types and flavors of beverages as may be possible in a footprint that may be as small as possible. Preferably, such a beverage dispensing system may provide as many beverages as may be available on the market in prepackaged bottles, cans, or other types of containers.

In order to accommodate this variety, the dispensing nozzles need to accommodate fluids with different viscosities, flow rates, mixing ratios, temperatures, and other variables. Current dispensing nozzle assemblies may not be able to accommodate multiple beverages with a single nozzle design and/or the dispensing nozzle assembly may be designed for specific types of fluid flow. One known means of accommodating differing flow characteristics is shown in commonly owned U.S. Pat. No. 7,383,966 that describes the use of replaceable fluid modules that are sized and shaped for specific flow characteristics. U.S. Pat. No. 7,383,966 is incorporated herein by reference in full. Even more variety and more fluid streams may be employed in commonly owned U.S. Pat. No. 7,578,415 that shows the use of a number of tertiary flow assemblies. U.S. Pat. No. 7,578,415 also is incorporated herein by reference in full.

Recent improvements in beverage dispensing technology have focused on the use of micro-ingredients. With micro-ingredients, the traditional beverage bases may be separated into their constituent parts at much higher dilution or reconstitution ratios. These micro-ingredients then may be stored in much smaller packages and stored closer to, adjacent to, or within the beverage dispenser itself. The beverage dispenser preferably may provide the consumer with multiple beverage options as well as the ability to customize the beverage as desired.

Beverage dispensers incorporating such highly concentrated micro-ingredients have proven to be highly popular with consumers. One example of the use of such micro-ingredients is shown in commonly owned U.S. Pat. No. 7,757,896 to Carpenter, et al., entitled "BEVERAGE DISPENSING SYSTEM." U.S. Pat. No. 7,757,896 is incorporated herein by reference herein in full. Such a dispenser thus employs the use of a dispensing nozzle assembly that can accommodate multiple streams of micro-ingredients as well as streams of macro-ingredients such as sweeteners and diluent. Such a dispensing nozzle assembly is shown in commonly-owned U.S. Pat. No. 7,866,509. U.S. Pat. No. 7,866,509 is incorporated herein by reference in full. Likewise, such micro-ingredient technology is incorporated in the highly popular "FREESTYLE®" refrigerated beverage dispensing units provided by The Coca-Cola Company of Atlanta, Ga. The "FREESTYLE®" refrigerated beverage dispensing units can dispense over 125 brands without the need for extensive storage space.

There is thus a desire for a dispensing nozzle assembly to accommodate even more and different types of fluids that may pass there through. The dispensing nozzle assembly preferably may accommodate this variety while still providing good mixing and easy cleaning.

SUMMARY OF THE INVENTION

The present application and the resultant patent thus provide a dispensing nozzle assembly. The dispensing nozzle assembly may include a core module assembly and an injector ring assembly surrounding the removable core module assembly. The injector ring assembly may include a number of first paths surrounding the core module assembly and extending to a dispensing ring and a number of second paths surrounding the first paths and extending to the dispensing ring.

The present application and the resultant patent further provide a dispensing nozzle assembly. The dispensing nozzle assembly may include a core module assembly with a first port and a second port and an injector ring assembly surrounding the core module assembly. The injector ring assembly may include a dispensing ring surrounding the core module assembly. The dispensing ring may include a number of outlet tubes. The outlet tubes may include an insert and/or surface treatment therein.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
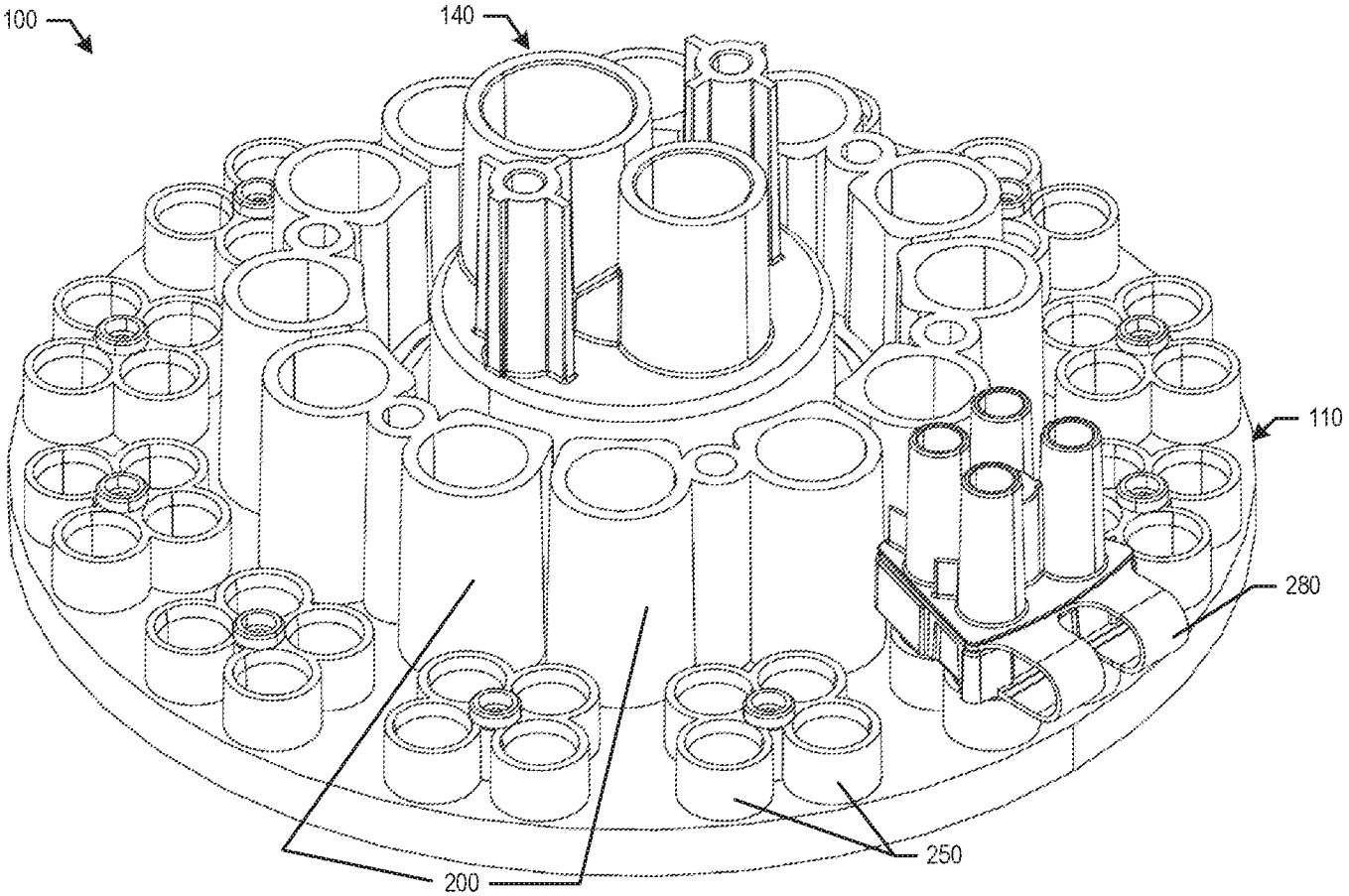
FIG. 1 is a perspective view of a dispensing nozzle assembly as described herein.
Figure 2:
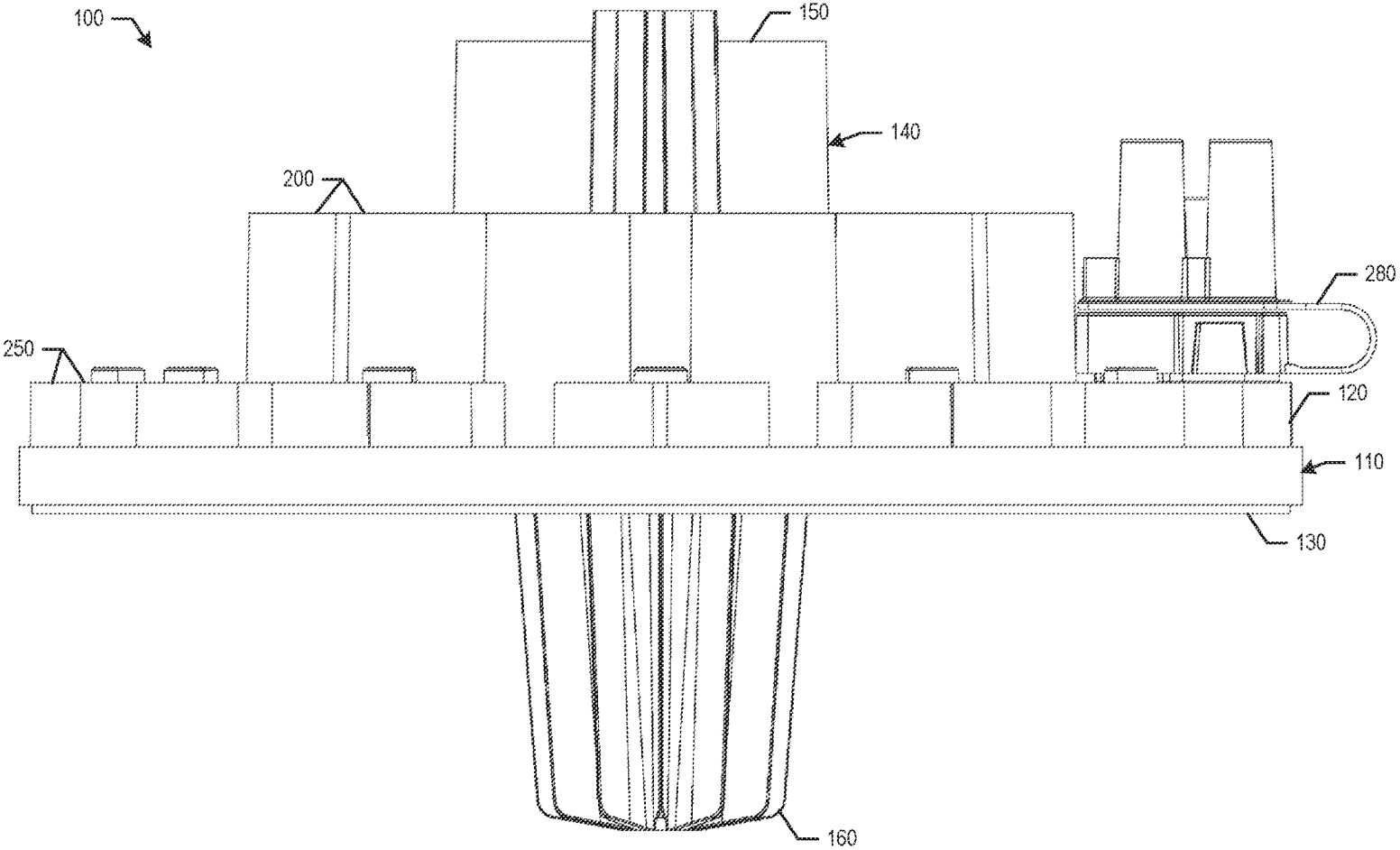
FIG. 2 is a side plan view of the dispensing nozzle assembly of FIG. 1.
Figure 3:
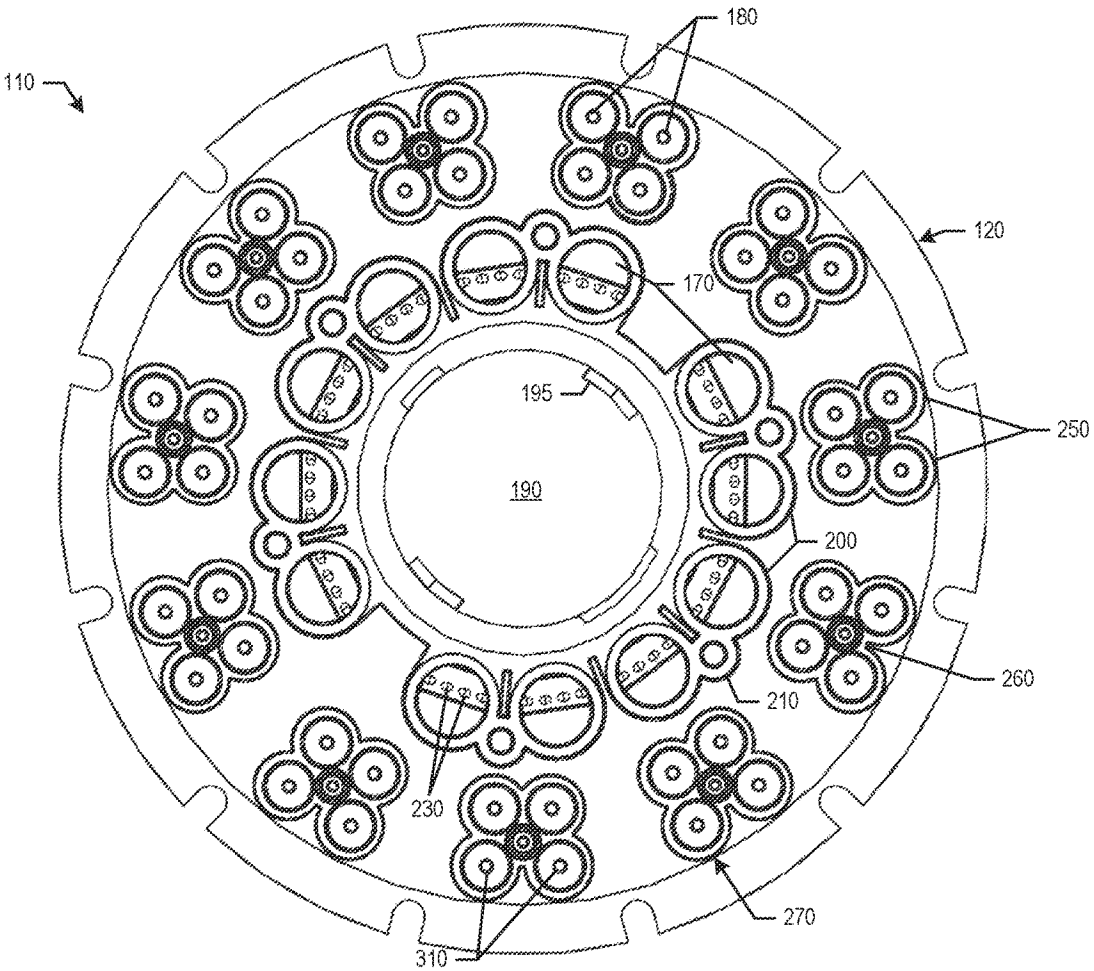
FIG. 3 is a top plan view of the injection ring assembly of the dispensing nozzle of FIG. 1.
Figure 4:
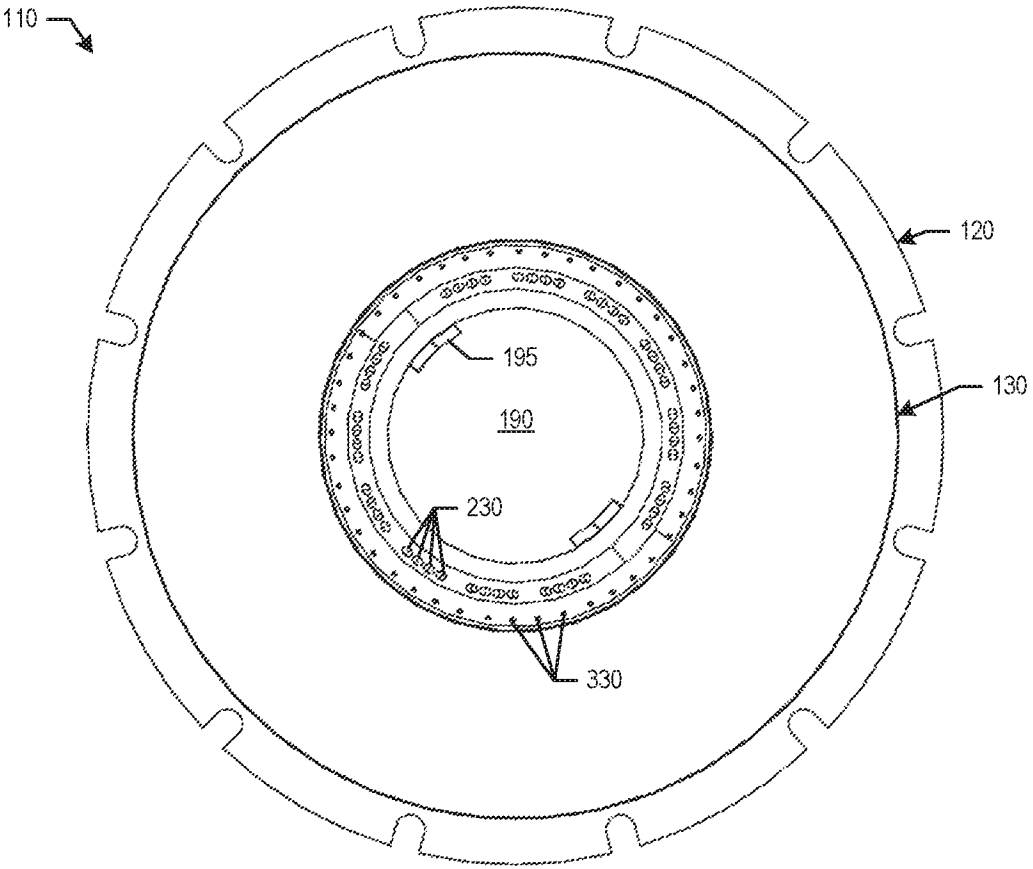
FIG. 4 is a bottom plan view of the injector ring assembly of the dispensing nozzle assembly of FIG. 1.
Figure 5:
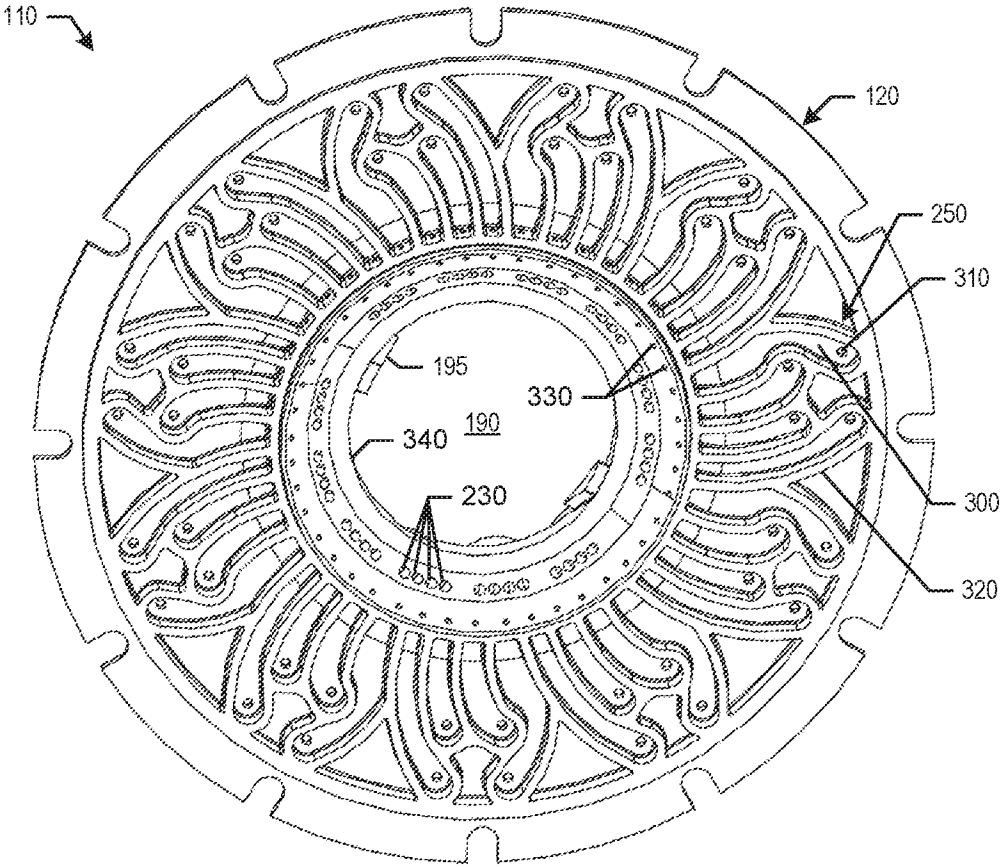
FIG. 5 is a bottom perspective view of an upper injector ring of the injector ring assembly of FIG. 3.
Figure 6:
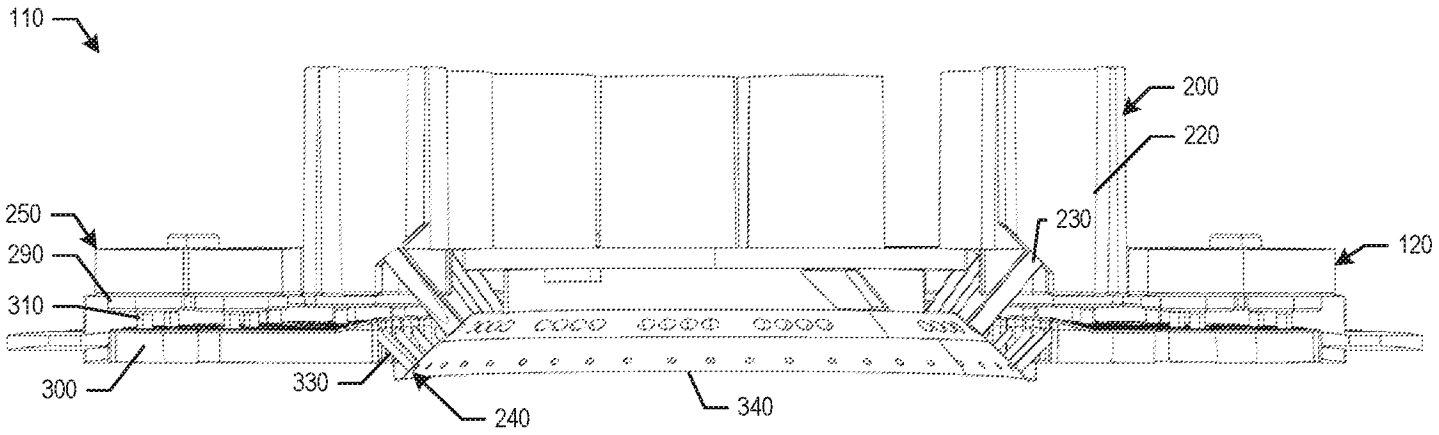
FIG. 6 is a partial sectional view of the upper injector ring of FIG. 5.
Figure 9:
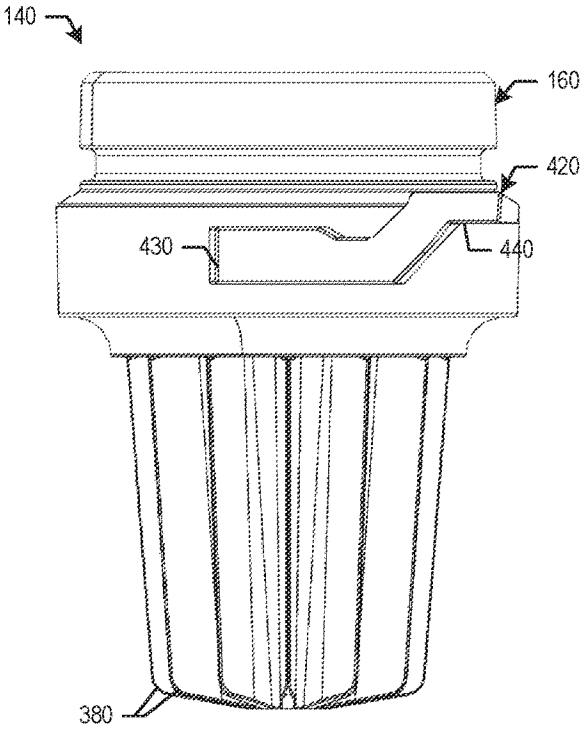
FIG. 9 is a side plan view of the core module assembly of FIG. 7.
Figure 8:
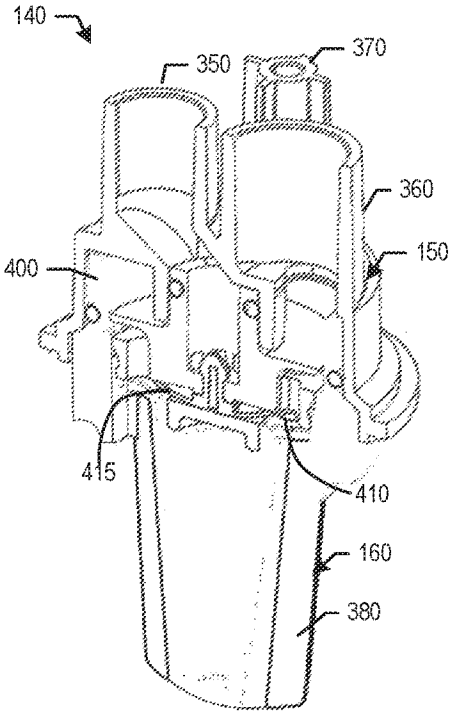
FIG. 8 is a partial sectional view of the core module assembly of FIG. 7.
Figure 7:
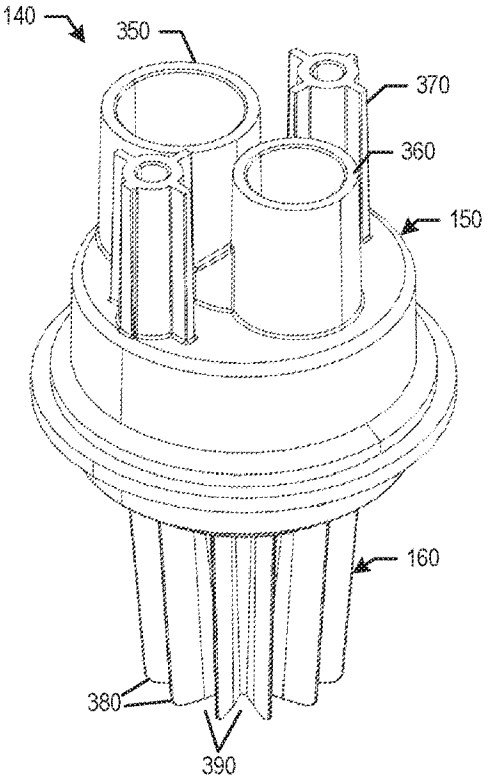
FIG. 7 is a perspective view of a core module assembly of the dispensing nozzle assembly of FIG. 1.

Referring now to the drawings, in which like numerals refer to like elements throughout the several views, FIG. 1 shows an example of a dispensing nozzle assembly 100 as is described herein. The dispensing nozzle assembly 100 may be used as part of a beverage dispenser for dispensing many different types of beverages or other types of fluids. Specifically, the dispensing nozzle assembly 100 may be used with diluents, macro-ingredients, micro-ingredients, and other types of fluids. The diluents generally include plain water (still water or non-carbonated water), carbonated water, and other fluids. The dispensing nozzle assembly 100 may be a common dispensing nozzle assembly. The term "common" is used herein to signify that the common dispensing nozzle assembly may be commonly used with many different types of beverages and beverage dispensers.

Generally described, the macro-ingredients may have reconstitution ratios in the range from full strength (no dilution) to about six (6) to one (1) (but generally less than about ten (10) to one (1)). The macro-ingredients may include sugar syrup, HFCS ("High Fructose Corn Syrup"), FIS ("Fully Inverted Sugar"), MIS ("Medium Inverted Sugar"), concentrated extracts, purees, and similar types of ingredients. Other ingredients may include traditional BIB ("Bag-in-box") flavored syrups, nutritive and non-nutritive sweetener blends, juice concentrates, dairy products, soy, and rice concentrates. Similarly, a macro-ingredient base product may include the sweetener as well as flavorings, acids, and other common components of a beverage syrup. The beverage syrup with sugar, HFCS, or other macro-ingredient base products generally may be stored in a conventional bag-in-box container remote from the dispenser. The viscosity of the macro-ingredients may range from about 1 to about 10,000 centipoise and generally over 100 centipoises or so when chilled. Other types of macro-ingredients may be used herein.

The micro-ingredients may have reconstitution ratios ranging from about ten (10) to one (1) and higher. Specifically, many micro-ingredients may have reconstitution ratios in the range of about 20:1, to 50:1, to 100:1, to 300:1, or higher. The viscosities of the micro-ingredients typically range from about one (1) to about six (6) centipoise or so, but may vary from this range. Examples of micro-ingredients include natural or artificial flavors; flavor additives; natural or artificial colors; artificial sweeteners (high potency, nonnutritive, or otherwise); antifoam agents, non-nutritive ingredients, additives for controlling tartness, e.g., citric acid or potassium citrate; functional additives such as vitamins, minerals, herbal extracts, nutricuticals; and over the counter (or otherwise) medicines such as pseudoephedrine, acetaminophen; and similar types of ingredients. Various types of alcohols may be used as either macro- or micro-ingredients. The micro-ingredients may be in liquid, gaseous, or powder form (and/or combinations thereof including soluble and suspended ingredients in a variety of media, including water, organic solvents, and oils). Other types of micro-ingredients may be used herein.

The dispensing nozzle assembly 100 may be largely modular in nature. The dispensing nozzle assembly 100 may include an injector ring assembly 110. The injector ring assembly 110 may include an upper injector ring 120 and a lower injector ring 130. The respective injector rings 120, 130 may be made out of a thermoplastic such as polypropylene and the like. Other types of food grade materials may be used herein. The injector rings 120, 130 may be injection molded or manufactured via other types of conventional techniques. The injector rings 120, 130 may be fastened together via laser welding techniques. The use of laser welding avoids the need for gaskets and the like. Other types of fastening techniques may be used herein.

The dispensing nozzle assembly 100 also may have a core module assembly 140. The core module assembly 140 may include a diluent/sweetener module 150 and a target assembly 160. The diluent/sweetener module 150 and the target assembly 160 also may be made out of a food grade thermoplastic such as polypropylene and the like. Other types of food grade materials may be used herein. The diluent/sweetener module 150 and the target assembly 160 may be injection molded or manufactured via other types of conventional techniques. The diluent/sweetener module 150 and the target assembly 160 may be in communication with the upper and lower injector rings 120, 130 of the injector ring assembly 110 as will be described in more detail below. In some embodiments, the diluent/sweetener module 150 may be fastened with the upper injector ring 120 such as via laser welding or other types of fastening techniques. Other components and other configurations may be used herein.

The injector ring assembly 110 may define a number of macro-ingredient paths 170 and a number of micro-ingredient paths 180 therethrough. FIGS. 3-6 show an example of the injector ring assembly 110. The injector ring assembly 110 may be largely plate like in shape with a central aperture 190 extending therethrough. The lower injector ring 130 may be largely flat and planar like in shape. The upper injector ring 120 may have the macro-ingredient paths 170 and the micro-ingredient paths 180 extending therethrough. The central aperture 190 may be sized and shaped for the diluent/sweetener module 150 and the target assembly 160. One or more assembly flanges 195 may extend into the central aperture 190. Other components and other configurations may be used herein.

Specifically, the upper injector ring 120 may include a number of macro-ingredient ports 200 of the macro-ingredient paths 170. In this example, there may be twelve (12) macro-ingredient ports 200 encircling about the central aperture 190 in whole or in part. Any number of the macro-ingredient ports 200 may be used herein in any position. The macro-ingredient ports 200 may be arranged in pairs with each pair sharing a macro-ingredient line fastener aperture 210. The macro-ingredient line fastener aperture 210 allows a macro-ingredient line to be secured thereto. The macro-ingredient ports 200 may be used and sized primarily for traditional beverage syrups that are typically housed in a bag-in-box container as described above although any type of macro-ingredient may be used herein.

Each macro-ingredient port 200 may include a macro-ingredient inlet chamber 220. The macro-ingredient inlet chamber 220 may be largely tube-like in shape. Each macro-ingredient inlet chamber 220 may lead to a number of macro-ingredient outlet tubes 230. In this example, each macro-ingredient inlet chamber 220 extends to four (4)

macro-ingredient outlet tubes 230. Any number of the macro-ingredient outlet tubes 230 may be used herein in communication with each macro-ingredient inlet chamber 220. The number of macro-ingredient outlet tubes 230 may vary in each macro-ingredient inlet chamber 220. The macro-ingredient outlet tubes 230 may have an angled configuration 240. Specifically, the macro-ingredient outlet tubes 230 may extend in the angled configuration 240 through the upper injector ring 120 to the central aperture 190 towards the target assembly 160. The angle may be about 40 to about 50 degrees although the angle may vary. The macro-ingredient outlet chambers 220 and the macro-ingredient outlet tubes 230 may have any suitable size, shape, or configuration. Other components and other configurations may be used herein.

The upper injector ring 120 also may include a number of micro-ingredient ports 250 of the micro-ingredient paths 180. The micro ingredient ports 250 may be used and sized primarily for use with the micro-ingredients. In this example, eleven (11) sets of four (4) micro-ingredient ports 250 are shown encircling the center aperture 190 concentrically with the macro-ingredient ports 200. Any number of the micro-ingredient ports 250 may be used herein in any configuration. Each set of the micro-ingredient ports 250 may have one or more micro-ingredient line fastener apertures 260 positioned there about. The micro-ingredient line fastener apertures 260 allow a micro-ingredient line to be secured thereto. The micro-ingredient ports 250 may be arranged in a quad configuration 270 of a set of four ports. The quad configuration 270 may accommodate a quad tube assembly 280 as shown in part in FIG. 1 and shown in U.S. Pat. No. 7,866,509 referenced above. Other components and other configurations may be used herein.

Each micro-ingredient port 250 may include a micro-ingredient inlet passage 290. The micro-ingredient inlet passages 290 may be largely tube-like in shape. The micro-ingredient inlet passages 290 may have any suitable size, shape, or configuration. Each micro-ingredient inlet passage 290 may lead to a micro-ingredient dispensing chamber 300. The micro-ingredient inlet passages 290 may be in communication with the micro-ingredient dispensing chambers 300 via a micro-ingredient dispensing chamber inlet tube 310. The micro-ingredient dispensing chamber inlet tube 310 may have a reduced diameter as compared to the micro-ingredient inlet passage 290. Each micro-ingredient dispensing chamber 300 may have a curved configuration 320 along the horizontal plane such that the upper injector ring 120 may accommodate as many micro-ingredient ports 250 as possible extending therethrough. Each micro-ingredient dispensing chamber 300 may be enclosed on the lower side by the lower injector ring 130. Each micro-ingredient dispensing chamber 300 may include a micro-ingredient dispensing chamber outlet tube 330. Each of the micro-ingredient dispensing chamber outlet tubes 330 may include the angled configuration 240. Specifically, the micro-ingredient dispensing chamber outlet tube 330 may extend in the angled configuration 240 from the micro-ingredient dispensing chamber 300 through the upper ring 120 and into the central aperture 190. The same or different angles may be used herein. The micro-ingredient dispensing chamber outlet tubes 330 may have a reduced diameter as compared to the micro-ingredient dispensing chamber inlet tubes 310. The micro-ingredient dispensing chamber outlet tubes 330 may extend below the macro-ingredient outlet tubes 230 along the angled configuration 240 in whole or in part. The micro-ingredient inlet passage 290, the micro-ingredient dispensing chamber inlet tubes 310, the micro-ingredient dispensing chamber 300, and the micro-ingredient dispensing chamber outlet tubes 330 may have any suitable size, shape, or configuration. Other components and other configurations may be used herein.

The macro-ingredient outlet tubes 230 and the micro-ingredient dispensing chamber outlet tubes 330 may extend through a dispensing ring 340 of the upper injector ring 120. The dispensing ring 340 may be a molded, unitary element of the upper injector ring 120 or the dispensing ring 340 may be a separate, added component. If a separate component, the dispensing ring 340 may be modular in nature and may be divided into any number of pie shaped elements or otherwise configured. The dispensing ring 340 may be made out of a thermoplastic like the rest of the upper injector ring 120 or a different material such as stainless steel or a ceramic. The macro-ingredient outlet tubes 230 and/or the micro-ingredient dispensing chamber outlet tubes 330 may be laser drilled through the dispensing ring 340. Other types of drilling techniques may be used herein. The use of a hydrophilic material such as stainless steel may prevent or limit fluid carryover, i.e., micro-ingredients may pool at the end of the micro-ingredient dispensing chamber outlet tube 330. Such pooled micro-ingredients may drip and/or carry over into the next beverage. The use of the angled configuration 240 also may assist in reducing carryover. Other components and other configurations may be used herein.

FIGS. 7-10 show an example of the core module assembly 140 with the diluent/sweetener module 150 and the target assembly 160. The diluent/sweetener module 150 may be attached to the target assembly 160 in a snap fit and the like. The diluent/sweetener module 150 may include a diluent port 350 and a sweetener port 360. The diluent/sweetener module 150 may include a diluent/sweetener module fastener aperture 370 extend therefrom. A diluent line and a sweetener line may be attached thereto. The target assembly 160 may include a number of vertically extending fins 380 that extend into a largely star-shaped appearance as viewed from the bottom. The fins 380 may form a number of U or V shaped channels 390.

When combined, the diluent/sweetener module 150 and the target assembly 160 may define a diluent/sweetener mixing chamber 400 therebetween. The target assembly 160 may have a number of diluent/sweetener dispensing ports 410 positioned about the diluent/sweetener mixing chamber 400. Specifically, the diluent/sweetener mixing chamber 400 may extend from the diluent port 350 and the sweetener port 360 to the diluent/sweetener dispensing ports 410. The dispensing ports 410 may be positioned over the fins 380 and the channels 390 of the target assembly 160. An umbrella valve 415 and the like also may be used herein.

The target assembly 160 may include an assembly track 420 formed thereon. The assembly track 420 may include a lower path 430 and an upper path 440. The assembly track 420 may be sized to accommodate the assembly flange 195 of the central aperture 190 of the injection ring assembly 110 so as to connect the core module assembly 140 to the injector ring assembly 110 (or vice versa). The assembly track 420 may have any suitable size, shape, or configuration. Other components and other configurations may be used herein.

In use, the upper injection ring 120 and the lower injection ring 130 may be combined so as to form the injector ring assembly 110. Likewise, the diluent/sweetener module 150 and the target assembly 160 may be combined so as to form the core module assembly 140. The core module assembly 140 may be positioned within the central aperture 190 of the injector ring assembly 110. The assembly track 420 of the core module assembly 140 may accommodate the assembly flange 195 of the injector ring assembly 110 so as to attach the core module assembly 140 in a screw-like action. Specifically, the assembly flange 195 may travel down the upper path 440 as the target assembly 160 is rotated clockwise. Continued rotation pulls the target assembly 160 into a secure fit as the assembly flange 195 travels along the lower path 430. The use of the assembly track 420 also provides for easy removal of the core module assembly 140 for cleaning the central aperture 190 of the injector ring assembly 110. Any order of assembly may be used herein. Any type of fasteners or joinders techniques also may be used herein. Other components and other configurations may be used herein.

A sweetener or other fluid may flow into the sweetener port 360 of the core module assembly 140 with a diluent flowing into the diluent port 350. The sweetener and the surrounding flow of diluent may mix in the diluent/sweetener mixing chamber in whole or in part and may be dispensed via the dispensing ports 410 of the target assembly 160. The diluent/sweetener mixture may flow downward through the channels 390 of the target assembly 160 and continue mixing therealong.

One or more macro-ingredients may flow into the macro-ingredient ports 200 of the upper injector ring 120 of the injector ring assembly 110. The macro-ingredients may flow through the macro-ingredient inlet chambers 220 and may be dispensed via the macro-ingredient outlet tubes 230 with the angled configuration 240 towards the target assembly 160. Having a number of the macro-ingredient outlet tubes 230 used in combination with each of the macro-ingredient inlet chambers 220 allows for good flow of the macro-ingredients therethrough.

Likewise, micro-ingredients may flow into the micro-ingredient ports 250 of the upper injector ring 120 of the injector ring assembly 110. The micro-ingredients may flow into the micro-ingredient passage 290 and into the micro-ingredient dispensing chamber 300 via the micro-ingredient dispensing chamber inlet tube 310. The micro-ingredients may pass through the micro-ingredient dispensing chamber 300 and may exit via the micro-ingredient dispensing chamber outlet tube 330 at the angled configuration 240 towards the targeted assembly 160. The diluent, the sweetener, the macro-ingredients, and/or the micro-ingredients all may mix as they flow along the target assembly 160 and fall towards a consumer's cup or other type of vessel. Different beverages may use different combinations of ingredients.

The common dispensing nozzle assembly 100 thus may be used to dispense any number of beverages. For example, a carbonated soft drink may include a flow of carbonated water as a diluent via the diluent port 350 and a flow of a conventional beverage syrup via one of the macro-ingredient ports 200. Alternatively, the carbonated soft drink also may include the flow of carbonated water via the diluent port 350, a flow of sweetener via the sweetener port 360, and a number of flows of micro-ingredients via the micro-ingredient ports 250. Further, a tea or coffee beverage may be created via a flow of still water as the diluent, a flow of tea concentrate as a macro-ingredient or a micro-ingredient, and a flow of a sweetener as a macro-ingredient or a micro-ingredient. Any number and combination of different beverages may be produced herein in a fast and efficient manner.

The dispensing nozzle assembly 100 may dispense syrups/concentrates with reconstitution ratios of anywhere from about three (3) to one (1) to about one hundred fifty (150) to one (1) or higher. The number, size, and shape of the various ports and pathways herein may be varied and reconfigured as desired. The dispensing nozzle assembly 100 thus may be used with almost any type of beverage dispenser. For example, the dispensing nozzle assembly 100 may be used with a conventional syrup based dispenser, a micro-ingredient based dispenser, and/or a hybrid or other type of dispenser based upon availability or any type of operational parameters or needs. The dispensing nozzle assembly 100 may be original equipment or part of a retrofit. Multiple dispensing nozzles assemblies 100 may be used together herein in different configurations.

The following chart shows how the dispensing nozzle assembly 100 may produce different types of beverages:

| Beverage | Diluent 350 | Sweetener 360 | Macro 230 | Micro 330 |
|---|---|---|---|---|
| Nutritive sweetened Micro-based | On | On | Off | 2+ On |
| Non-nutritive Sweetened Micro-based | On | Off | Off | 2+ On |
| Macro-Based | On | Off | One On | Off |
| Flavored Macro-Based | On | Off | One On | 1+ On |
| Mid-calorie Micro-based | On | On | Off | 3+ On |

Figure 11:
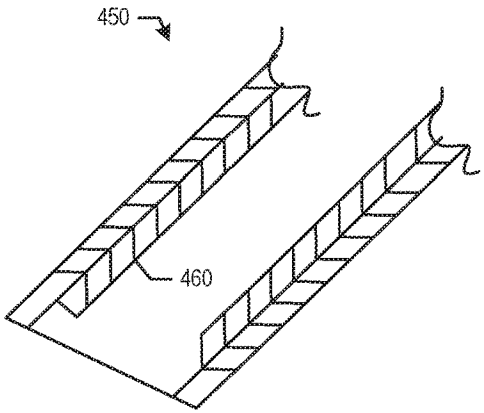
FIG. 11 is a partial section view of an alternative embodiment of an outlet tube as may be described herein.
Figure 10:
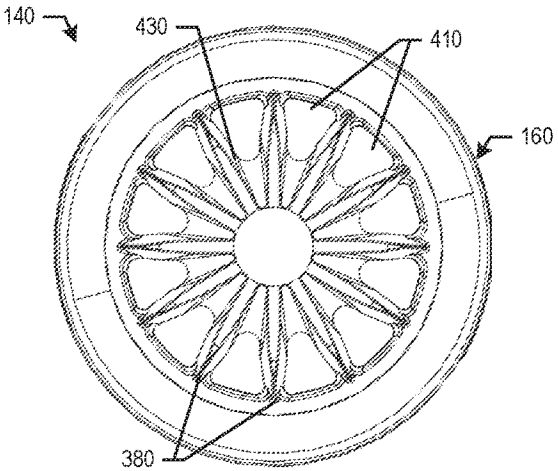
FIG. 10 is a bottom plan view of the core module assembly of FIG. 7.

FIG. 11 shows an alternative embodiment of a micro-ingredient dispensing chamber outlet tube 450. The micro-ingredient dispensing chamber outlet tube 450 may have the angled configuration 240 extending through the dispensing ring 340. The micro-ingredient dispensing chamber outlet tube 450 may include an insert 460 therein. The insert 460 may be made out of a stainless steel, a ceramic, or other types of a hydrophilic material in whole or in part. As described above, the micro-ingredient dispensing chamber outlet tubes 450 may be laser drilled through a plastic material of the dispensing ring 340 or otherwise formed therein. The plastic material may be largely hydrophobic. By using different materials and positions therein, the hydrophilic/hydrophobic ratio of the micro-ingredient dispensing chamber outlet tubes 450 may be varied. Specifically, the hydrophilic material tends to hold the micro-ingredients within the micro-ingredient dispensing chamber outlet tube 450 so as to resist carryover between dispenses. The insert 460 thus may not extend the entire length of the micro-ingredient dispensing chamber outlet tube 450. Rather, a length of the plastic material may extend at the exit. Other components and other configurations may be used herein.

Figure 12:
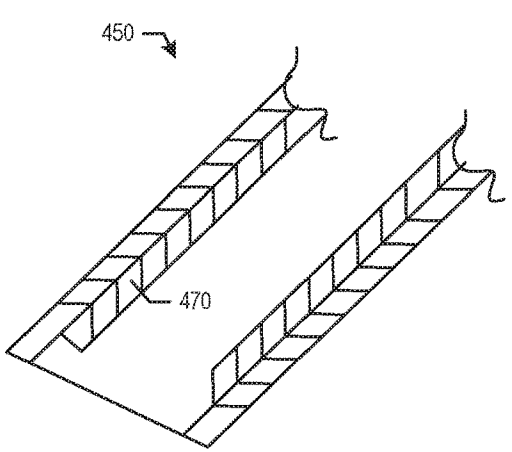
FIG. 12 is a partial section view of an alternative embodiment of an outlet tube as may be described herein.

Alternatively as shown in FIG. 12, the micro-ingredient dispensing chamber outlet tube 450 may include a surface treatment 470 therein. The surface treatment 470 also may vary hydrophilic properties of the micro-ingredient dispensing chamber outlet tubes 450 in whole or in part. As above, the surface treatment 470 may end before the exit of the micro-ingredient dispensing chamber outlet tube 450 given the hydrophobic properties of the plastic.

To the extent that the dispensing ring 340 is made out of stainless steel or similar types of material, each micro-ingredient dispensing chamber outlet tube 450 may take the form of any number of smaller tubes drilled therethrough. The tubes may have the same or a number of different shapes. The use of a number of smaller holes may fan out the velocity of the micro-ingredient stream so as to slow the stream while creating additional surface tension to prevent dripping. The use of the insert 460, the surface treatment 470, and the angled configuration 240 all may contribute to reduce dripping and carryover. The insert 460, the surface treatment 470, and the angled configuration 240 may be used separately or in combination. Other components and other configurations may be used herein.

Figure 13:
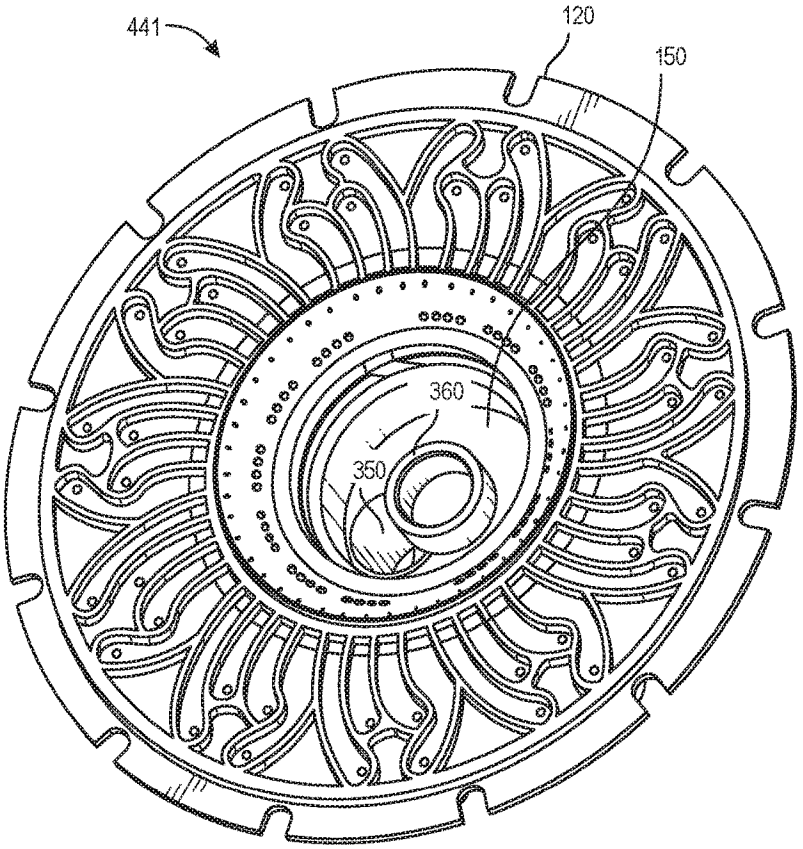
FIG. 13 is a bottom perspective view of a dispensing nozzle assembly as may be described herein.

FIG. 13 shows an alternative embodiment of a dispensing nozzle assembly 441. In this example, the diluent/sweetener module 150 may be attached to the upper injection ring 120. The diluent/sweetener module 150 may be attached by laser welding or other types of joinder means. The diluent port 350 and the sweetener port 360 may be brought into fluid communication with the dispensing ports 410 by attaching the target assembly 160 to the upper injection ring 120 via the assembly flange 195. Other components and other configurations may be used herein.

Figure 14:
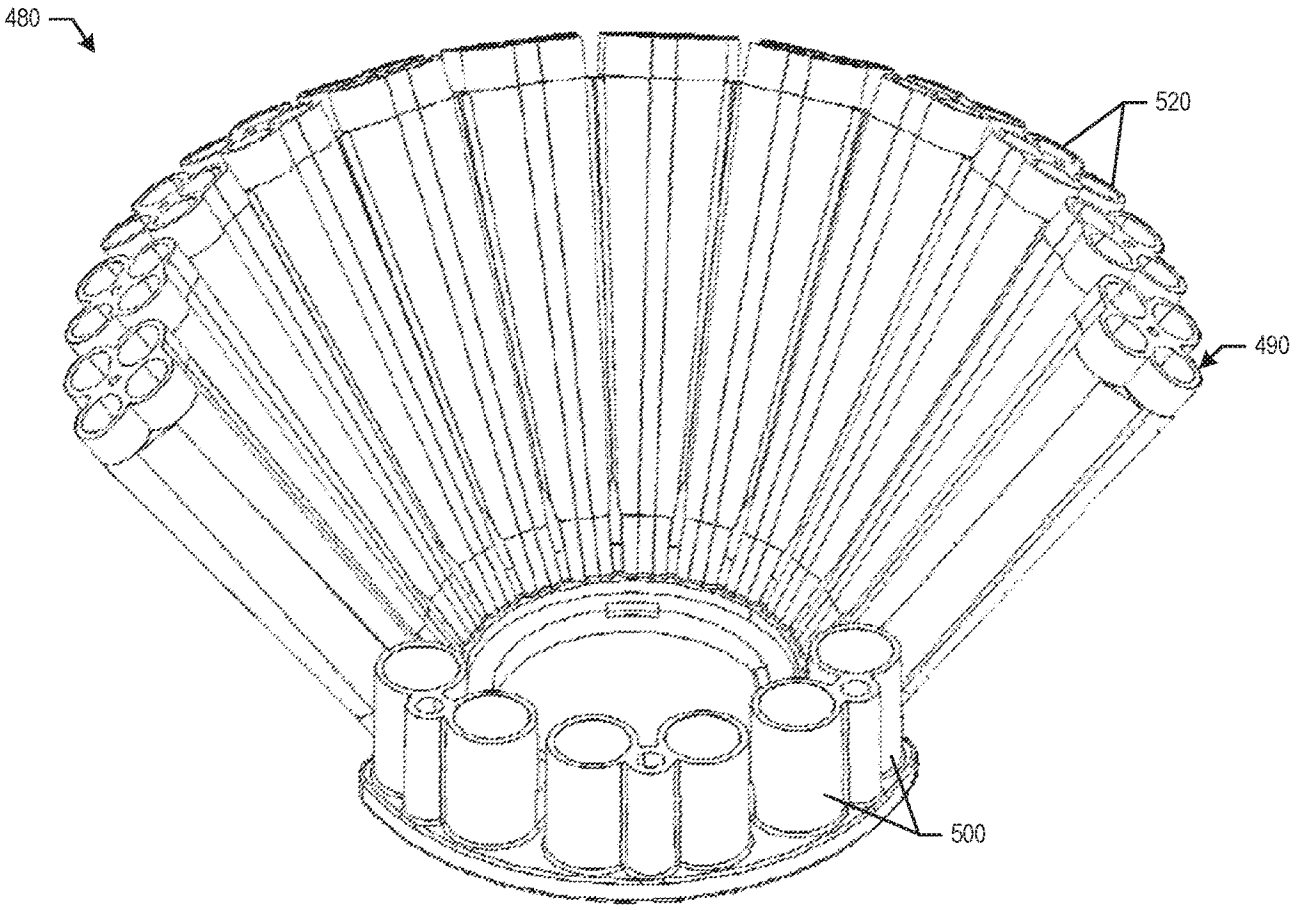
FIG. 14 is a perspective view of an alternative embodiment of a dispensing nozzle assembly as may be described herein.
Figure 15:
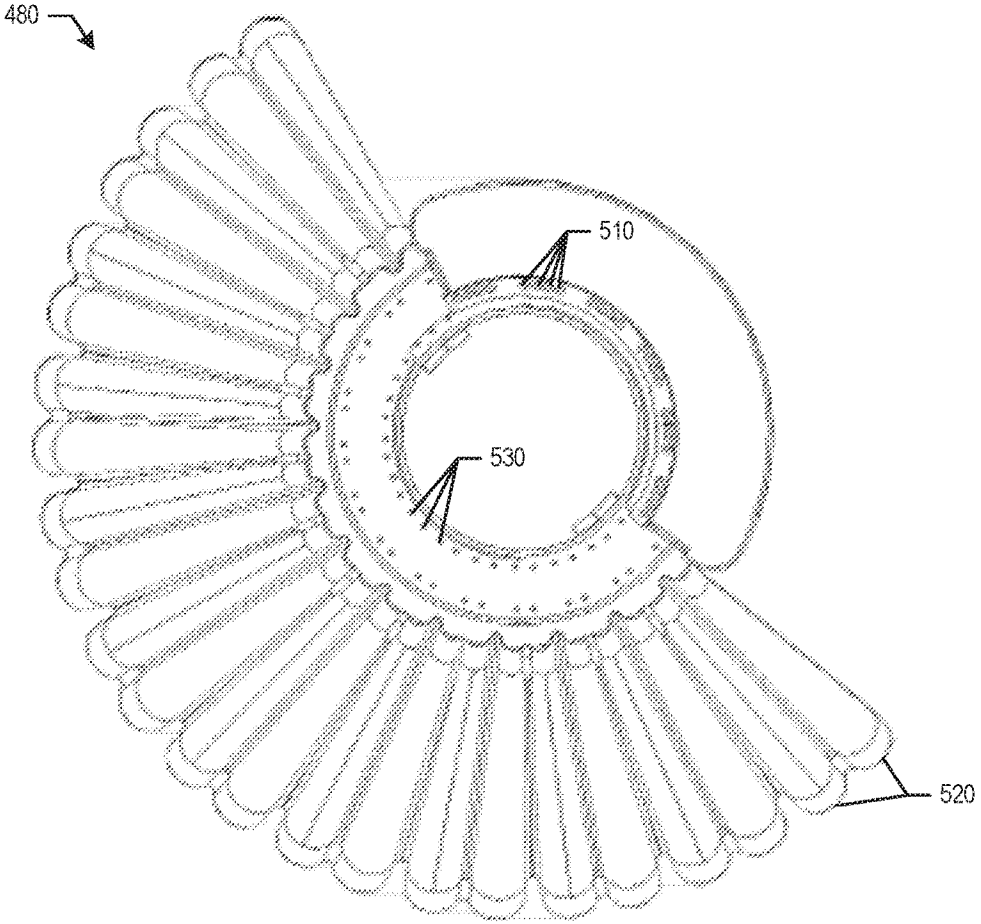
FIG. 15 is a bottom plan view of the dispensing nozzle assembly of FIG. 14.

FIGS. 14 and 15 show a further embodiment of a dispensing nozzle assembly 480 as may be described herein. The dispensing nozzle assembly 480 may be a single molded piece 490. Specifically, the dispensing nozzle assembly 480 may include a number of macro-ingredient ports leading to macro-ingredient outlets 510 and a number of micro-ingredient ports 520 leading to a number of micro-ingredient outlets 530. The macro-ingredient ports 500 and/or the micro ingredient ports 520 may be molded using core pins along most of their lengths. The outlets 510 and 530 then may be drilled via laser or other types of conventional techniques. In this example, the length of the micro-ingredient ports 520 may be increased so as to increase the total number of micro-ingredient ports 520 that may be used herein as the single molded piece 490. Other components and other configurations may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A dispensing nozzle assembly, comprising:
- a core module assembly; and
- an injector ring assembly;
- the injector ring assembly comprising a plurality of first paths surrounding the core module assembly and extending to a dispensing ring; and
- the injector ring assembly comprising a plurality of second paths concentrically surrounding the plurality of first paths and extending to the dispensing ring.

2. The dispensing nozzle assembly of claim 1, wherein the injector ring assembly comprises an upper injector ring and a lower injector ring.

3. The dispensing nozzle assembly of claim 2, wherein the upper injector ring comprises the first path and the second path therethrough.

4. The dispensing nozzle assembly of claim 3, wherein the lower injector ring comprises a planar disc.

5. The dispensing nozzle assembly of claim 1, wherein the plurality of first paths comprises a plurality of macro-ingredient paths.

6. The dispensing nozzle assembly of claim 5, wherein the plurality of macro-ingredient paths each comprise a macro-ingredient inlet chamber and a plurality of macro-ingredient outlet tubes extending through the dispensing ring.

7. The dispensing nozzle assembly of claim 1, wherein the plurality of second paths comprises a plurality of micro-ingredient paths.

8. The dispensing nozzle assembly of claim 7, wherein the plurality of micro-ingredient paths each comprise a micro-ingredient dispensing chamber with a micro-ingredient dispensing chamber outlet tube extending through the dispensing ring.

9. The dispensing nozzle assembly of claim 8, wherein the micro-ingredient dispensing chamber outlet tube comprises an angled configuration extending through the dispensing ring.

10. The dispensing nozzle assembly of claim 8, wherein the micro-ingredient dispensing chamber outlet tube comprises a laser drilled micro-ingredient dispensing chamber outlet tube.

11. The dispensing nozzle assembly of claim 8, wherein the micro-ingredient dispensing chamber outlet tube comprises an insert and/or surface treatment therein.

12. The dispensing nozzle assembly of claim 1, wherein the core module assembly comprises a sweetener port and a diluent port.

13. The dispensing nozzle assembly of claim 1, wherein the core module assembly comprises a diluent/sweetener module and a target assembly.

14. The dispensing nozzle assembly of claim 13, wherein diluent/sweetener module and the target assembly define a diluent/sweetener mixing chamber therebetween.

15. The dispensing nozzle assembly of claim 13, wherein the target assembly comprises a plurality of diluent/sweetener dispensing ports.

16. The dispensing nozzle assembly of claim 1, wherein the core module assembly comprises an assembly track with a lower path and an upper path for being removably attached within the injector ring assembly.

17. The dispensing nozzle assembly of claim 1, wherein the upper injector ring and the lower injector ring comprise a single piece.

18. A dispensing nozzle assembly, comprising:
- a core module assembly with a first port and a second port; and
- an injector ring assembly;
- the injector ring assembly comprising a dispensing ring surrounding the core module assembly;
- the dispensing ring comprising a plurality of outlet tubes surrounding the core module assembly;
- the plurality of outlet tubes comprising a plurality of second paths concentrically surrounding a plurality of first paths; and
- the plurality of outlet tubes comprising an insert and/or surface treatment therein.

19. The dispensing nozzle assembly of claim 18, wherein the dispensing ring comprises stainless steel.

20. The dispensing nozzle assembly of claim 18, wherein the dispensing ring comprises a separate element.

* * * * *